US006457620B1

(12) United States Patent
Batten et al.

(10) Patent No.: US 6,457,620 B1
(45) Date of Patent: Oct. 1, 2002

(54) GOLF BAGS AND GOLF BAG CARRYING SYSTEMS

(75) Inventors: Mike Batten, Paragould, AR (US); Teh I Chang, Kowloon (HK)

(73) Assignee: Ya Fang Tang, Kowloon (HK)

( * ) Notice: Subject to any disclaimer, the term of this patent is extended or adjusted under 35 U.S.C. 154(b) by 0 days.

(21) Appl. No.: 09/756,709

(22) Filed: Jan. 10, 2001

(51) Int. Cl.[7] ..... A45F 3/04

(52) U.S. Cl. ..... 224/645; 224/260; 224/627; 206/315.3

(58) Field of Search ..... 224/641, 643, 224/645, 647, 627, 259, 260; 206/315.3, 315.2

(56) References Cited

U.S. PATENT DOCUMENTS

| | | | | | |
|---|---|---|---|---|---|
| 726,842 | A | * | 5/1903 | Bauer | 2/306 |
| 1,868,828 | A | * | 7/1932 | Haines | 24/312 |
| 2,853,111 | A | | 9/1958 | Williams | 150/1.5 |
| 5,038,984 | A | | 8/1991 | Izzo | 224/209 |
| 5,042,703 | A | | 8/1991 | Izzo | 224/209 |
| 5,042,704 | A | | 8/1991 | Izzo | 224/209 |
| 5,125,718 | A | * | 6/1992 | Czernakowski et al. | 24/630 |
| 5,361,953 | A | * | 11/1994 | Nichols | 224/192 |
| D362,752 | S | * | 10/1995 | Steurer | 224/627 |
| 5,988,475 | A | | 11/1999 | Han | 224/608 |
| 6,006,974 | A | | 12/1999 | Varney et al. | 224/645 |
| 6,152,342 | A | * | 11/2000 | Suk | 224/259 |
| 6,305,535 | B1 | * | 10/2001 | Fair | 206/315.3 |

* cited by examiner

*Primary Examiner*—Stephen K. Cronin
(74) *Attorney, Agent, or Firm*—Jacobson Holman, PLLC

(57) ABSTRACT

A strap connector for connecting the shoulder straps of a dual-strap carrying system which is particularly useful for carrying golf bags or other elongate bags including pivotally connected lateral members each of which is connected as an intermediate member of a shoulder strap. The pivotal connection between the lateral members adjusts the weight distribution on the shoulders of a person carrying the bag and provides improved comfortability. Also disclosed are a strap carrying system and a golf bag including the strap connector.

18 Claims, 12 Drawing Sheets

SIDE VIEW

FRONT VIEW

TOP VIEW

GOLF BAGS AND GOLF BAG CARRYING SYSTEMS

FIELD OF THE INVENTION

The present invention relates to golf bags and more particularly, to strap carrying systems for golf and other bags of an elongated shape. The present invention also relates to a strap connector for a dual strap carrying system for golf and other bags.

BACKGROUND OF THE INVENTION

Golf is an outdoor sporting game the popularity of which is increasing in many parts of the world. The game of golf is played on a golf course on which there are disposed a plurality of holes, typically in multiples of nine holes, into which a golfer has to sequentially hit the ball in order to complete a game. The cumulative distance between the holes of a golf course, commonly termed "yardage", which is the minimum distance that a golfer has to cover in order to traverse all the holes, is typically in the region of six thousand meters for a eighteen-hole golf course.

In playing a golf game, a player is required to drive a golf ball sequentially into all the designated holes with a minimum of strokes. The distances between adjacent holes may vary from the shortest of about one hundred meters to the longest of about five hundred meters. Some holes are flanked by rough and uneven areas and hazards, requiring a player to walk through them and play with increased intricacy and precision. When striking a golf ball towards a hole, a number of strokes and different clubs, for example, wood, iron or putter, which may impart different flight characteristics to a golf ball may be used in order to get the most optimal drive. As a golf player has to move from the starting point to the finishing point in a single direction, it would be highly desirable if a full set of golf clubs can accompany the golfer in the course of the game.

Golf clubs and other golfing accessories such as golf balls are usually carried in a golf bag which is normally a cylindrical bag having an open end through which golf clubs are inserted. A fully loaded golf bag can weigh between ten to fifteen kilograms when the bag is at rest. Many golf courses are located outside the cities or urban areas and some are even not accessible by roads. In some circumstances, it would be very difficult and extremely tiring if a person has to carry a fully loaded golf bag from and to courses and between holes.

To facilitate easy transport of golf bags, carrying systems with shoulder straps which enable a person to carry a golf bag by the shoulder(s) have been available. Strap carriers usually come in as the single-strap or the dual-strap styles. In the single-strap type, a padded strap is usually connected between the top and middle portions of the golf bag to form a single shoulder loop. A person inserts his arm into the shoulder loop in order to carry the golf bag. In this system, the weight of the golf bag is rested entirely on a single shoulder of the person carrying the golf bag. In the dual-strap system, two shoulder straps are attached to a golf bag, usually also at the middle and top portions of the golf bag. A person inserts his arms into the shoulder loops and the weight of the golf bag will be shared between the shoulders. In order to distribute the weight of the golf bag on both shoulders, both strap members need to be taut or under tension. The shoulder straps are usually adjustable in length so that the tension, and therefore, the weight distribution on the shoulders on each individual strap can be varied.

In the ordinary use of the dual-strap system, a person carrying the bag will usually adjust the length of the strap so that the weight is most comfortably distributed on the shoulders when the person is standing still in an upright posture. Examples of such dual-strap systems have been described in many U.S. patents including U.S. Pat. Nos. 2,853,111, 5,038,984, 5,042,703 and 5,042,704.

A major shortcoming of known dual-strap systems is that while the weight distribution on the shoulders can be pre-set by adjusting the tension on the shoulder straps when a person is standing still, the weight distribution may significantly change once the carrying person begins to move, for example, when the person is walking forward, moving up-hill, down-hill, upstairs, downstairs and over and across barriers. When a person is walking forward in a normal manner, it is known that there is a tendency that the shoulders swing horizontally and reciprocally about the vertical axis of the body. The forward shoulder will pull the strap attaching to that shoulder forward and will therefore bear an increased amount of tension. On the other hand, when a person is walking up-hill, down-hill, upstairs, downstairs and over and across barriers, there is a tendency that the shoulders swing vertically and, as a result of the swings, the shoulder which is instantaneously elevated or upwardly tilted will lift the strap on that shoulder and therefore bear most of the weight. As the dynamic weight of a golf bag is significantly higher than its static weight (the weight when it is stationary) due to bouncing and jolting of the golf clubs which are usually loosely placed in a golf bag for easy retrieval, the stress and strain on the forward, elevated or upwardly-tilted shoulder will be significantly higher than what a person will experience when he is standing still. This is particularly undesirable if a person has to travel for a long distance and on an uneven path.

Therefore, it will be highly desirable if an improved dual-strap system which can alleviate the afore-mentioned shortcoming of known and existing dual-strap carrying systems can be provided to make the carrying of a fully loaded golf bag a more enjoyable exercise.

Another shortcoming of known dual-strap carrying systems is that, because the two straps are usually independently connected to a golf bag, the tension on each of the straps is dependent on the longitudinal locations at which they are attached to the golf bag as a result of uneven weight distribution along the length of the bag. For example, for a golf bag loaded only with golf clubs, all the weight will be concentrated near the open end since the weight of a golf club is generally concentrated at the club-head portion and the heads are kept near the open end. In such a case, the right-shoulder strap will bear most of the weight. On the other hand, if the golf bag is fully loaded with something other than clubs, for example, golf balls, the weight can be expected to concentrate near the closed bottom end and the left shoulder will be expected to bear most of the weight. Hence, it will be desirable if an improved carrying system in which the tension in the straps can be less dependent on the attachment locations can be provided.

Furthermore, while dual-strap carrying systems are preferred for carrying a fully loaded golf bag for a long distance, it is sometimes more convenient to carry a golf bag with a single shoulder strap carrying system since a golf bag can be loaded and unloaded more easily which is more preferable if only a short distance is to be covered. Hence, it would be highly desirable if the improved dual-strap carrying system can be easily converted into a single-strap system if and when the person carrying the bag so desires.

U.S. Pat. No. 6,006,974 discloses a dual-strap system which can be converted into a single-strap system. However, in the conversion of the '974 system, one of the shoulder straps has to be disconnected and stored in the golf bag which increases the load as well as not making use of both available straps to increase padding thickness. Hence, it would be desirable if, upon the conversion of a dual-strap to a single-strap system, both straps can be utilised as a shoulder strap for carrying the golf bag.

OBJECTION OF THE INVENTION

It is therefore an object of the present invention to provide an improved dual-strap carrying system which can alleviate the known short-coming of existing dual-strap systems for a golf bag in which the dynamic weight of the golf bag being carried is alternately concentrated on a single shoulder as a result of the motion of the person carrying the golf bag. It is also an object of the present invention to provide an improved strap connector which can be utilised in the afore-said improved dual-strap carrying system. It is a further object of the present invention to provide an improved strap connector and an improved dual-strap carrying system for a golf bag so that the tensions on the shoulder straps are less dependent on the locations at which the straps are connected to the golf bag. Furthermore, it is at least an object of the present invention to provide the general public with a useful choice or alternative to existing dual-strap carrying systems or connectors therefor.

SUMMARY OF THE INVENTION

According to the present invention, there is provided a strap connector for a dual strap bag carrying system including first and second lateral members which said lateral members are pivotally connectable together and are disposed on opposite sides of the pivotal point joining the same ("First Pivotal Point"), each said lateral member includes a first and a second spaced apart anchoring means which are laterally displaced from the First Pivotal Point and are disposed on the same side of the First Pivotal Point, said First Pivotal Point is disposed intermediate between said first and second strap anchoring means on a lateral member, and said First Pivotal Point is disposed so that it is adjacent to all the four strap anchoring means.

Preferably, one of the strap anchoring means on each lateral member is pivotably moveable with respect to the said lateral member on which it is attached.

According to a second aspect of the present invention, there is provided a dual-strap carrying system for a golf bag including first and second shoulder strap portions, first and second low strap portions, and a strap connector, wherein said strap connector includes first and second lateral members which said lateral members are pivotally connectable together and are disposed on opposite sides of the pivotal point joining the same ("First Pivotal Point"), each said lateral member includes a first and a second spaced apart anchoring means which are laterally displaced from the First Pivotal Point and are disposed on the same side of the First Pivotal Point, said First Pivotal Point is disposed intermediate between said first and second strap anchoring means on a lateral member, and said First Pivotal Point is disposed so that it is adjacent to all the four strap anchoring means.

According to a third aspect of the present invention, there is provided a golf bag in combination with a dual-strap carrying system as described above.

BRIEF DESCRIPTION OF THE DRAWINGS

Embodiments of the present invention will now be explained in more details by way of examples and with reference to the accompanying drawings, in which.

DETAILED DESCRIPTION OF THE PREFERRED EMBODIMENTS

Figure 1:
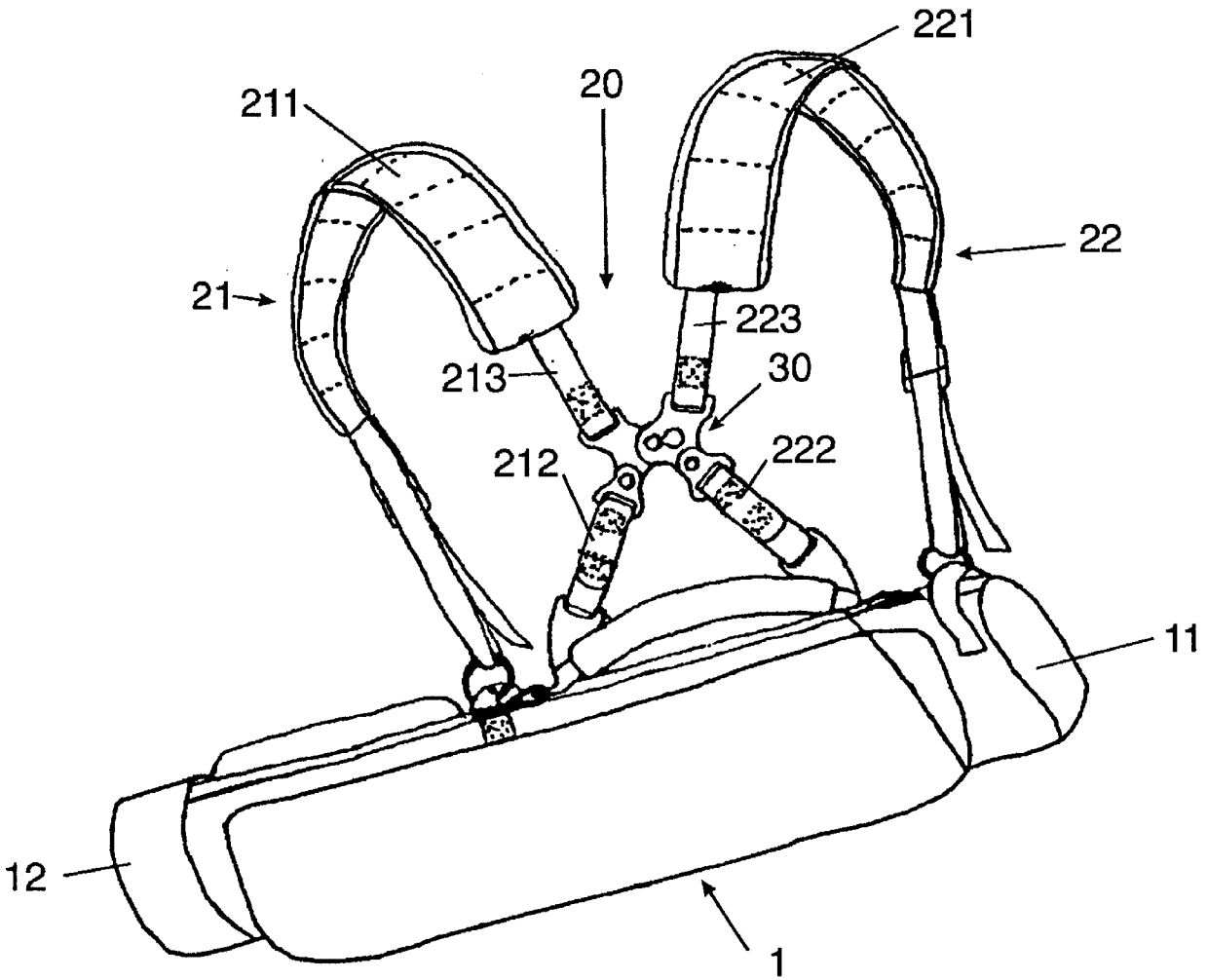
FIG. 1 shows a dual-strap carrying system of the present invention in combination with a conventional golf bag.

A conventional golf bag (1) with an improved dual-strap carrying system of the present invention is shown in FIG. 1. The golf bag may be a conventional cylindrical bag which has a partitioned open end (11) for receiving golf clubs and a closed end (the base) (12) on which the entire golf bag can be supported in a substantially upright manner. The strap carrying system (20) includes a first (21) and a second (22) carrying straps which are interconnected by a strap connector (30). Each of the carrying straps includes a shoulder strap portion (211, 221) and a lower strap portion (212, 222) interconnected by a lateral member of the strap connector. A dual-strap carrying system generally includes a first and a second shoulder loop. The two ends of the first shoulder loop are preferably attached to the golf bag near its middle portion while the two ends of the second shoulder loop are preferably attached near the open end (11) of the golf bag. In the ordinary use of the dual-strap carrying system, the left and right arm of the carrying person are inserted respectively into the first and second shoulder loops so that the first (211) and second (221) shoulder strap portions rest respectively on the left and right shoulders of the person with the golf bag being carried on the back of the person. Referring to FIGS. 2–11, there is shown a first embodiment of a strap connector (30) of the present invention. The strap connector (30) includes a first (31) and a second (32) lateral member which are pivotally connected together. The strap connector (30) is preferably made of a strong and rigid material of adequate tensile of strength such as hard plastic, for example acetal, nylon, metal, or metal alloy, to withstand the weight of a fully loaded golf bag. Each of the lateral members is provided with a first (311, 321) and a second (312, 322) strap anchoring means which are adapted respectively to receive and anchor the ends of the corresponding shoulder strap portion and the lower strap portion which are not attached to the golf bag. In the instant embodiment the first lateral member (31) is designed to receive the first shoulder strap portion (211) and the first lower strap portion (212) while the second lateral member (32) is for receiving the second shoulder portion (221) and the second lower strap portion (222).

The strap anchoring means may include a buckle member which includes an elongated slot corresponding to the width of the strap portion to be received or anchored as in the present example. Where a strap portion has been terminated with a hook or clip or other appropriate devices, or where the strap portion end has been made into a rounded shape, the elongated slot may no longer be necessary and can be replaced by an appropriate receptacle such as a rounded aperture or other suitable coupling means adapted to secure the straps on the lateral member.

The anchoring means (311, 312, 321, 322) on a lateral member are laterally displaced from the pivotal point (33) joining the two lateral members so that the anchoring means on the same lateral member are located at positions which are between the pivotal point (33) and the positions at which the carrying strap portions anchoring on that lateral member join the golf bag.

In addition to being laterally displaced from the pivotal point, the two anchoring means are also vertically spaced from each other so that the portion of the lateral member joining the two anchoring means becomes a portion or an extension of the weight bearing carrying straps. In another perspective, it will be apparent that anchoring means and the pivotal point (33) are disposed in a manner such that the anchoring means form the four vertices of a quadrangle with the pivot point (33) enclosed inside, preferably near or at the intersection of the diagonals joining the vertices. Furthermore, it is also apparent in the present embodiment that the buckle member (312) which is connected to the lower strap portion is pivotally attached to the lateral member.

With the pivotal connection between the two lateral members (31, 32), the angular width between the two shoulder strap portions can be adjusted to fit the shoulder width of a particular built. Also, because of the pivotally mounted buckles for anchoring the two lower strap portions, the angular width between the two lower strap portions (212, 222) can be adjusted in accordance with the separation of the anchoring points formed on the golf bag, thereby making the present dual strap system more flexible to adapt to golf bag of various design and different manufacture.

Figure 6:
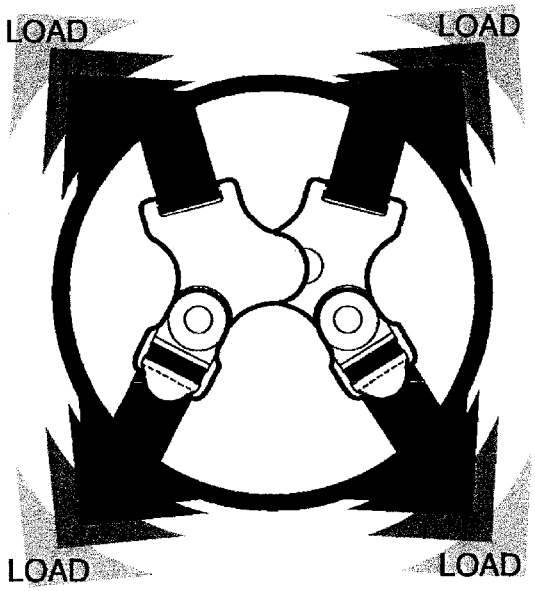
FIG. 6 is a schematic diagram showing typical weight distribution on the shoulder straps in a dual-strap carrying system of FIG. 5 when the person carrying the bag is standing still on an even surface.

FIGS. 5–9 illustrates the present dual strap system in its ordinary use. FIG. 6 shows for example the preferred and usual weight distribution on the dual-strap carrying system when a person carrying the golf bag on his shoulders is in a standing still posture with the shoulder strap adjusted so that there is comparable tension on both shoulder strap portions. When a person is walking, for example when he walks forward, up-hill, down-hill, upstairs, down-stairs or walks up a barrier, it is known that there is a tendency that he will lift or elevate one of his shoulders or move one of his shoulders forward.

Figure 7:
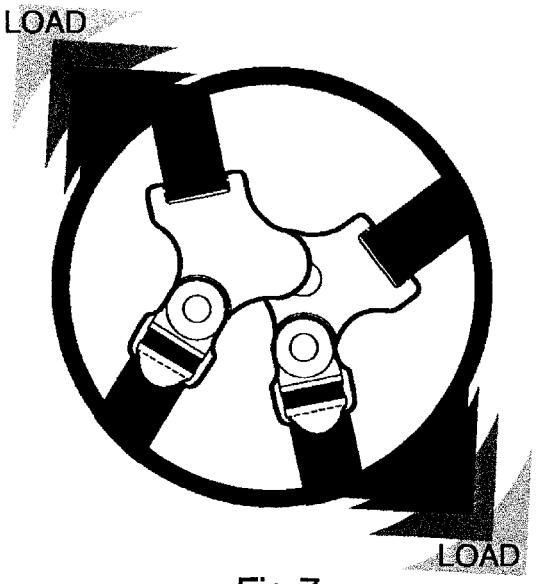
FIG. 7 is a schematic diagram showing typical weight distribution on the shoulder straps of the dual-strap carrying system of FIG. 6 when the left shoulder of the carrying person is elevated or upwardly-tilted or forward.
Figure 8:
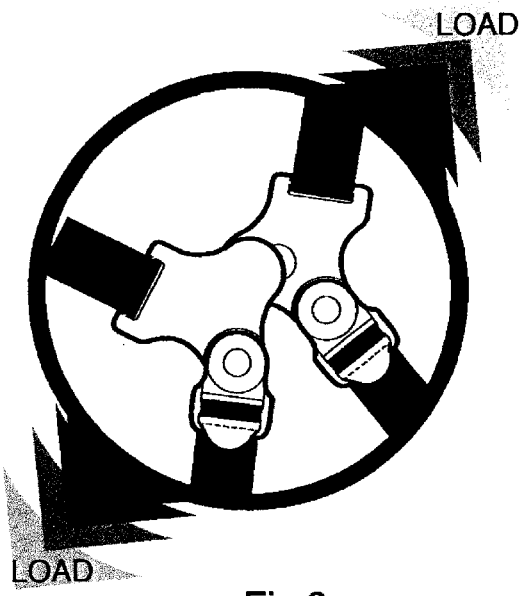
FIG. 8 is a schematic diagram showing typical weight distribution on the shoulder straps of the dual-strap carrying system of FIG. 6 when the right shoulder of the carrying person is elevated or upwardly-tilted or forward.

Assuming now without loss of generality for the sake of explanation that the left shoulder is now lifted, elevated or moved forward. Following the movement of the left shoulder, the first shoulder strap (211) together with the first lateral member (31) will be lifted accordingly as shown in FIG. 7. In a conventional dual strap system, the second shoulder strap portion (221), i.e. the shoulder strap portion resting on the right shoulder, would have become slack as a result. However, because of the pivotal connection between the two lateral members (31, 32), the tension on the second lower strap portion (222), i.e. the lower strap portion on the right side, will pull against the second lateral member (32), thereby increasing the tension on the second shoulder strap portion (221) and off-setting to some extent the loss of tension on the second shoulder portion (221) resulting from the uplifting of the first shoulder portion (211). At these instances, it would be noted that the angular width between the first (211) and the second (221) shoulder straps has been slightly increased to reflect the tension pulling on the first (31) and the second lateral (32) members respectively by the first (212) and the second (222) lower strap portion. To substantially maintain the same angular width between the two lower strap portions, the first (312) and the second (322) anchoring means are preferably pivotally attached to the second lateral member so that they can pivotally move respectively in a clockwise or an anti-clockwise direction relative respectively to the first (31) and the second (32) lateral members to maintain the same angular width. Similarly, when the right shoulder is lifted or elevated or moved forward as a result of a person's motion, the second shoulder strap (221) together with the second lateral member (32) will be lifted accordingly as shown in FIG. 8. In a conventional dual strap system, the first shoulder strap portion (211), i.e. the shoulder strap portion resting on the left shoulder, would have become slack as a result. However, because of the pivotal connection between the two lateral members (31, 32), the tension on the first lower strap portion (212), i.e. the lower strap portion on the right side, will pull against the first lateral member (31), thereby increasing the tension on the first shoulder strap portion (211) and off-setting to some extent the loss of tension on the first shoulder portion (211) resulting from the uplifting of the second shoulder portion (221).

In the present invention, it will be noted that the tension on the two lower straps (212, 222), which may be different due to the uneven distribution of weight along the length of the golf bag, will be distributed more evenly on the two shoulder straps (211, 221) as a result of the transitional termination of tension on the strap connector (30).

While the present embodiment has been described with lower anchoring means which are pivotally, it would be obvious and understood that the strap connector can function in substantially the same way even if the strap anchoring means are fixedly connected to the lateral member. In such a case, because of the flexible nature of the lower strap portions, the angular width between the two lower strap portions will substantially remain the same but the second lower straps may be somewhat twisted as a result, depending on the extent of shoulder lifting. To release the twisting tension in the lower strap portion, pivotally connected lower strap portion anchoring means on the lateral members are preferable. Alternatively, instead of having the strap anchoring means (311, 322) for the lower strap portions pivotally connected to the lateral members, the strap anchoring means (312, 322) for the shoulder strap portions (211, 221) may be pivotally connected to the lateral member and achieving a substantially similar result.

Figure 2:
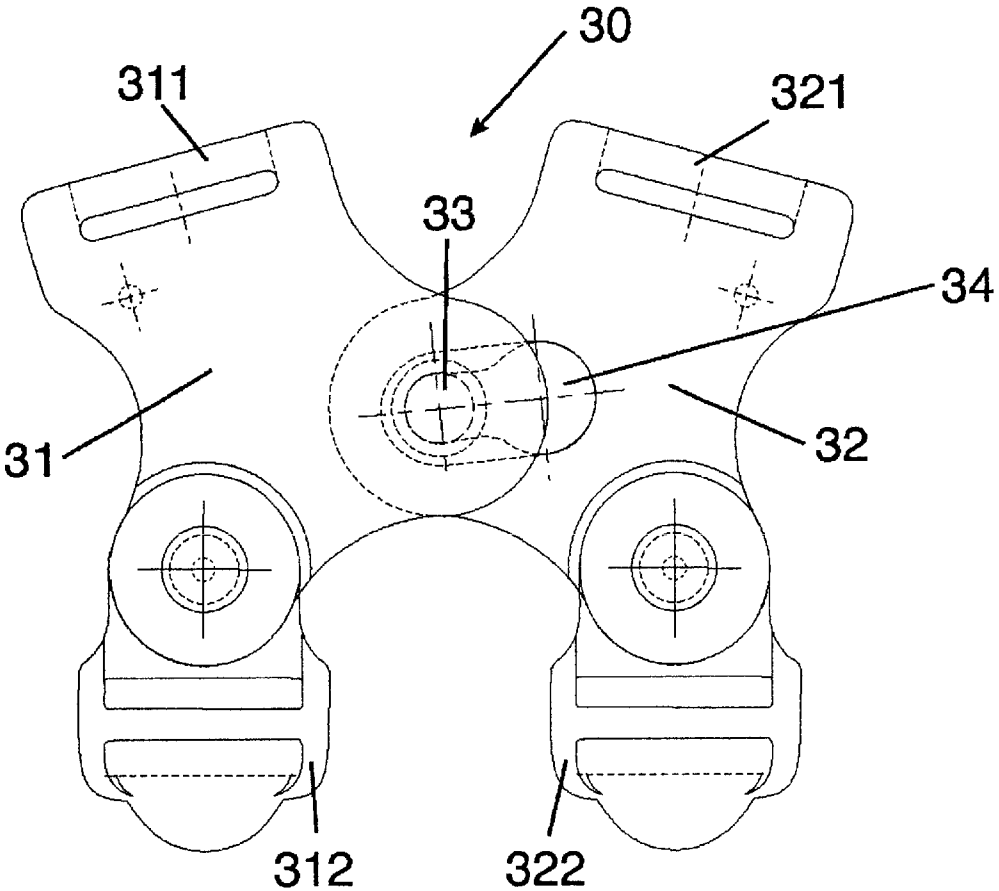
FIG. 2 shows a first embodiment of a strap connector of the present invention.
Figure 4B:
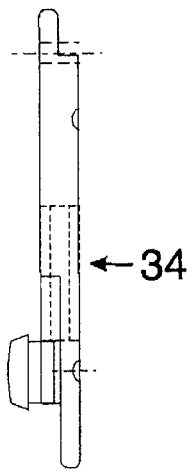
Figure 4C:
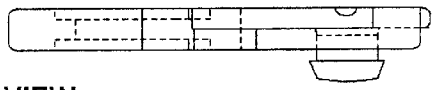
Figure 4A:
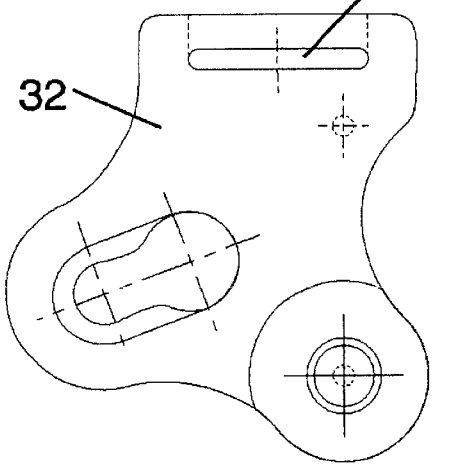
Figure 3B:
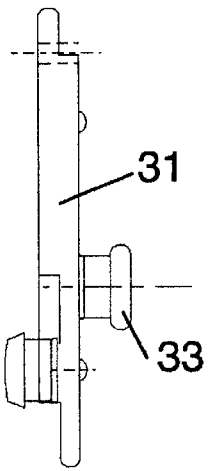
FIGS. 3*a*–3*c* show the front, side and top views of a first lateral member of the strap connector of FIG. 2, FIGS. 4*a*–4*c* show the front, side and top views of a second lateral member of the strap connector of FIG. 2.
Figure 3C:
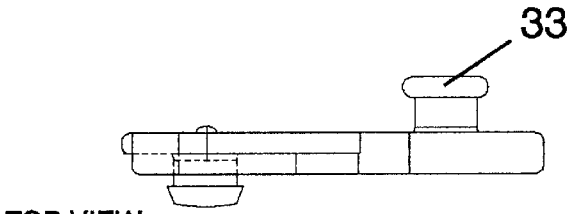
Figure 3A:
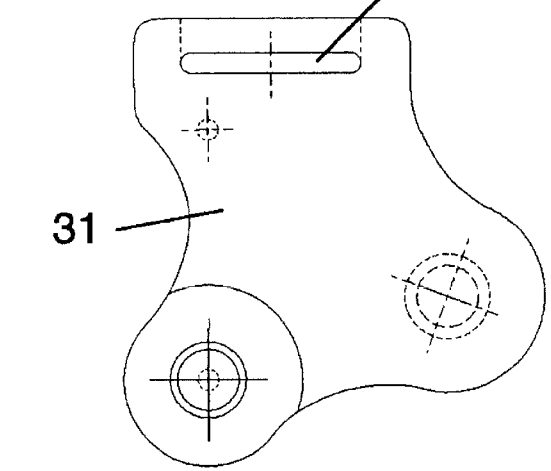
Figure 5:
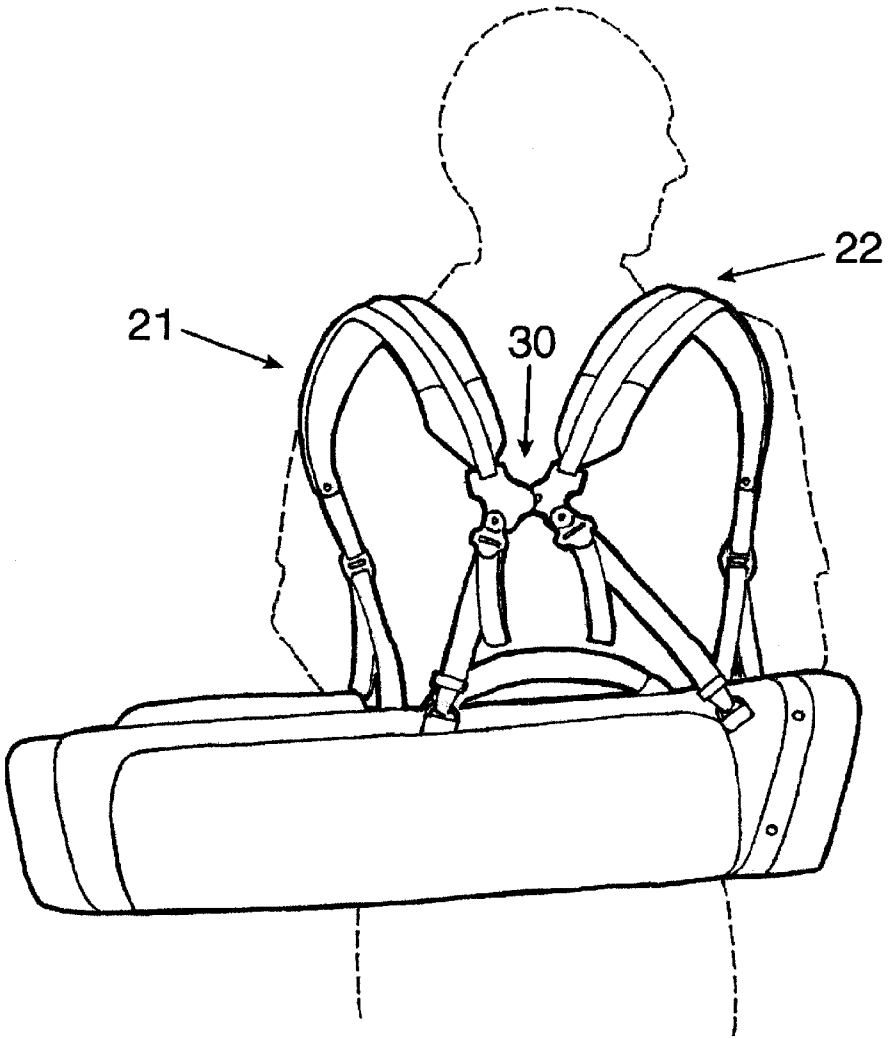
FIG. 5 illustrates a person carrying a golf bag with a dual-strap carrying system incorporating the strap connector of FIG. 2.

Referring to FIGS. 2 and 3, it will be noted that the two lateral members are substantially of mirror or lateral symmetry to each other and are detachably connected. The detachable connection is preferably by a key-hole coupling system but it will be appreciated that other detachable connection systems which allow relative pivotal movements of the two lateral member can also be used. The key-hole system includes a stud member (33) on one of the lateral members and a key-hole opening (34) comprising a larger and a small aperture on the other lateral member. The stud member (33) can pass through the larger aperture on the key-hole opening while retained by the smaller aperture, thereby achieving a detachable pivotal connection between the two lateral members (31, 32).

Figure 9B:
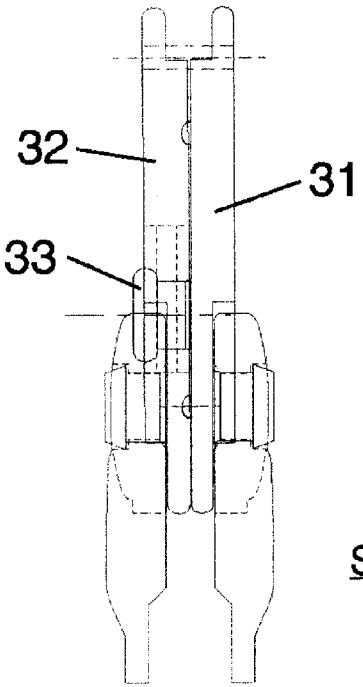
FIGS. 9*a*–9*c* show the front, side and top views of the strap connector of FIG. 2 when it has been converted into a strap connector for a single-strap system.
Figure 9A:
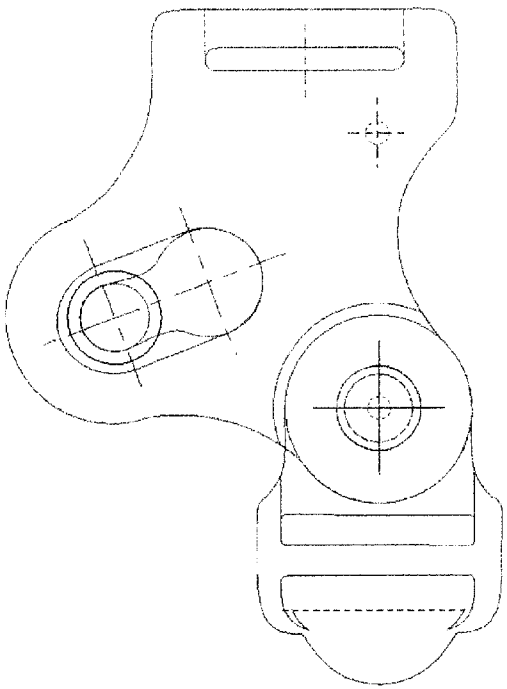
Figure 9C:
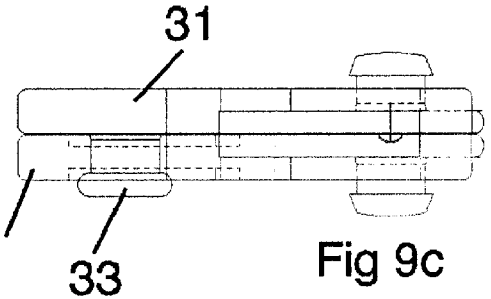
Figure 10:
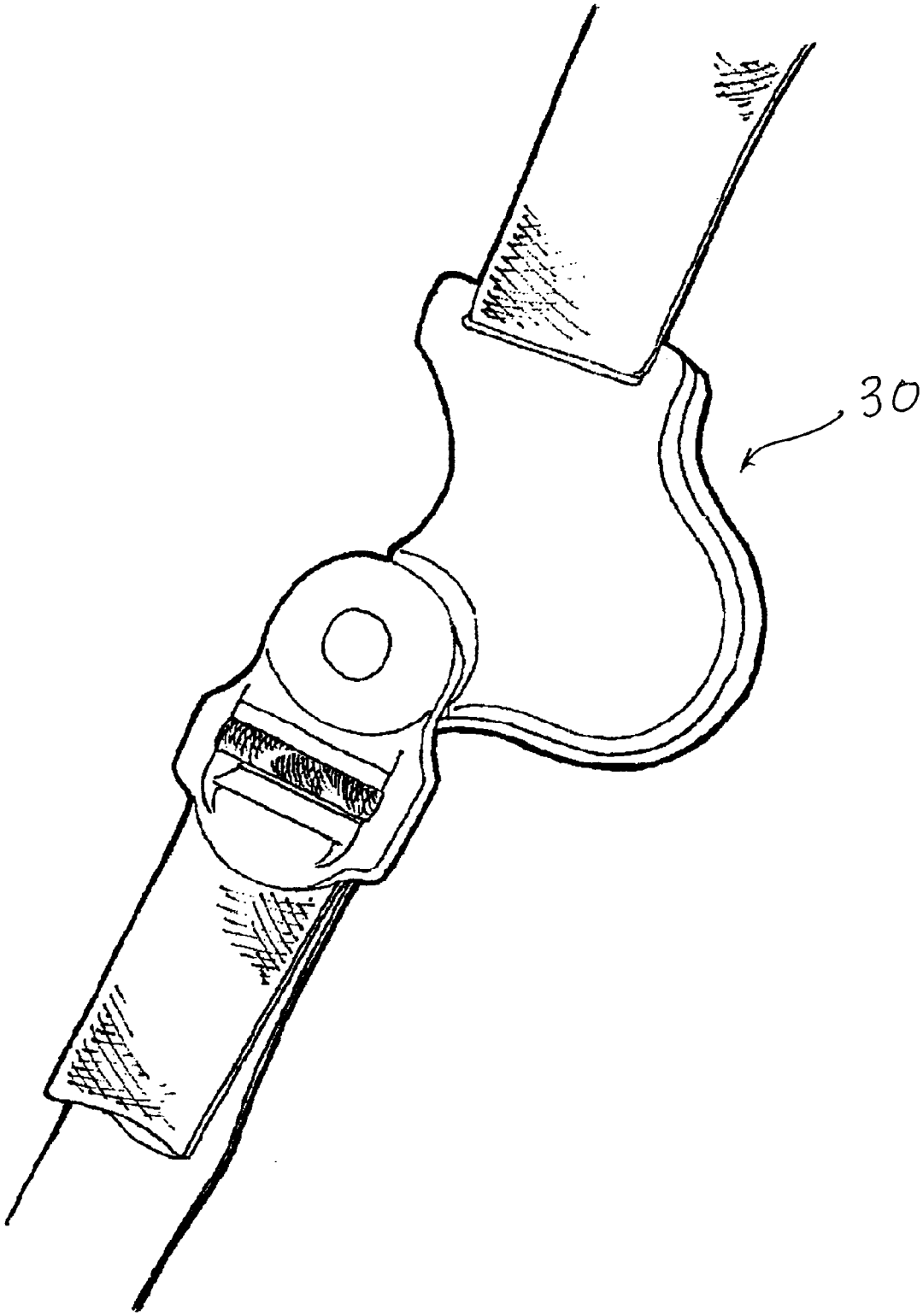
FIG. 10 illustrates a portion of a single shoulder strap carrying system using the singlestrap connector of FIG. 9.
Figure 11:
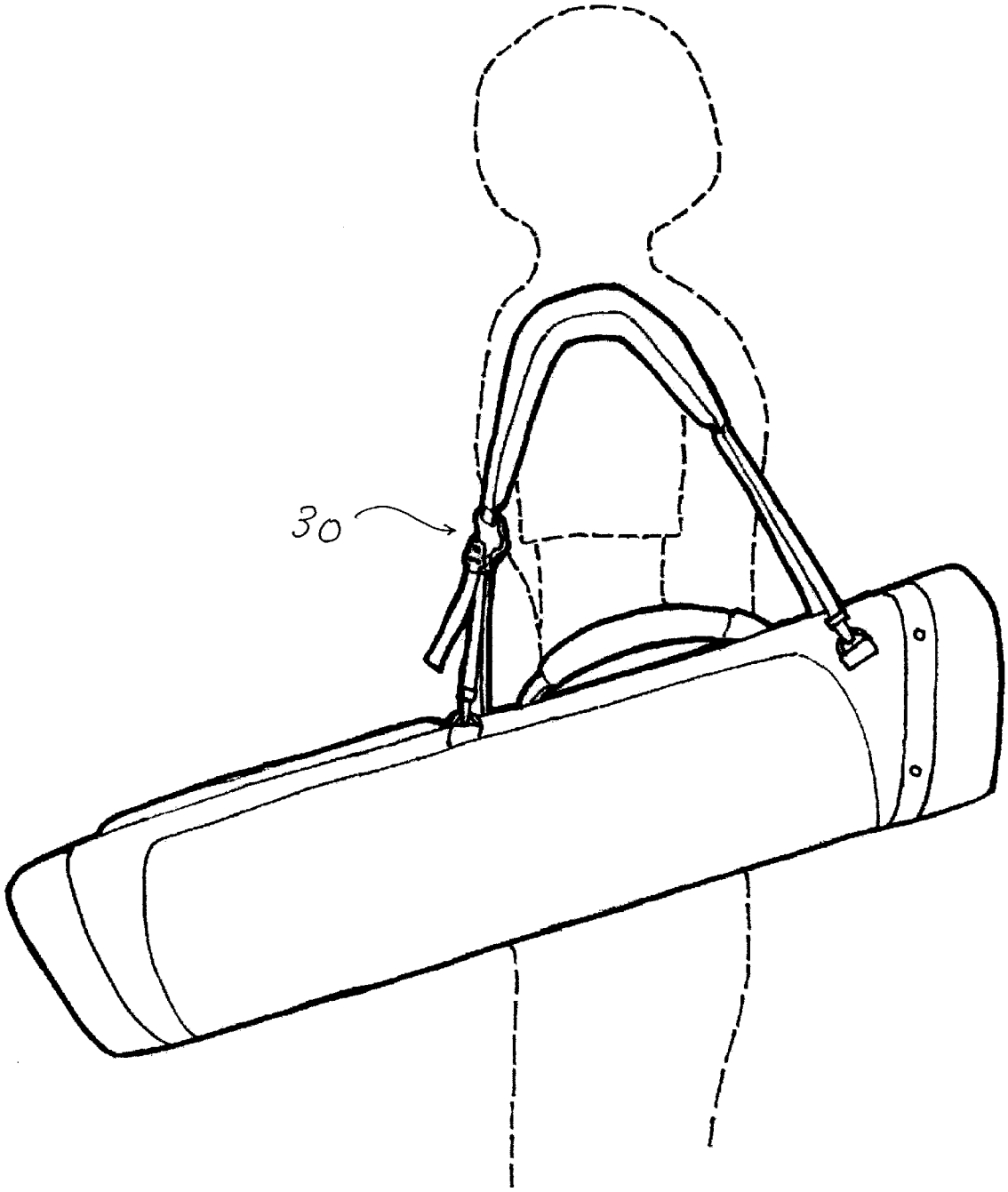
FIG. 11 illustrates a golf bag with a single-strap carrying system of the present invention when carried by a person on the right shoulder.
Figure 15:
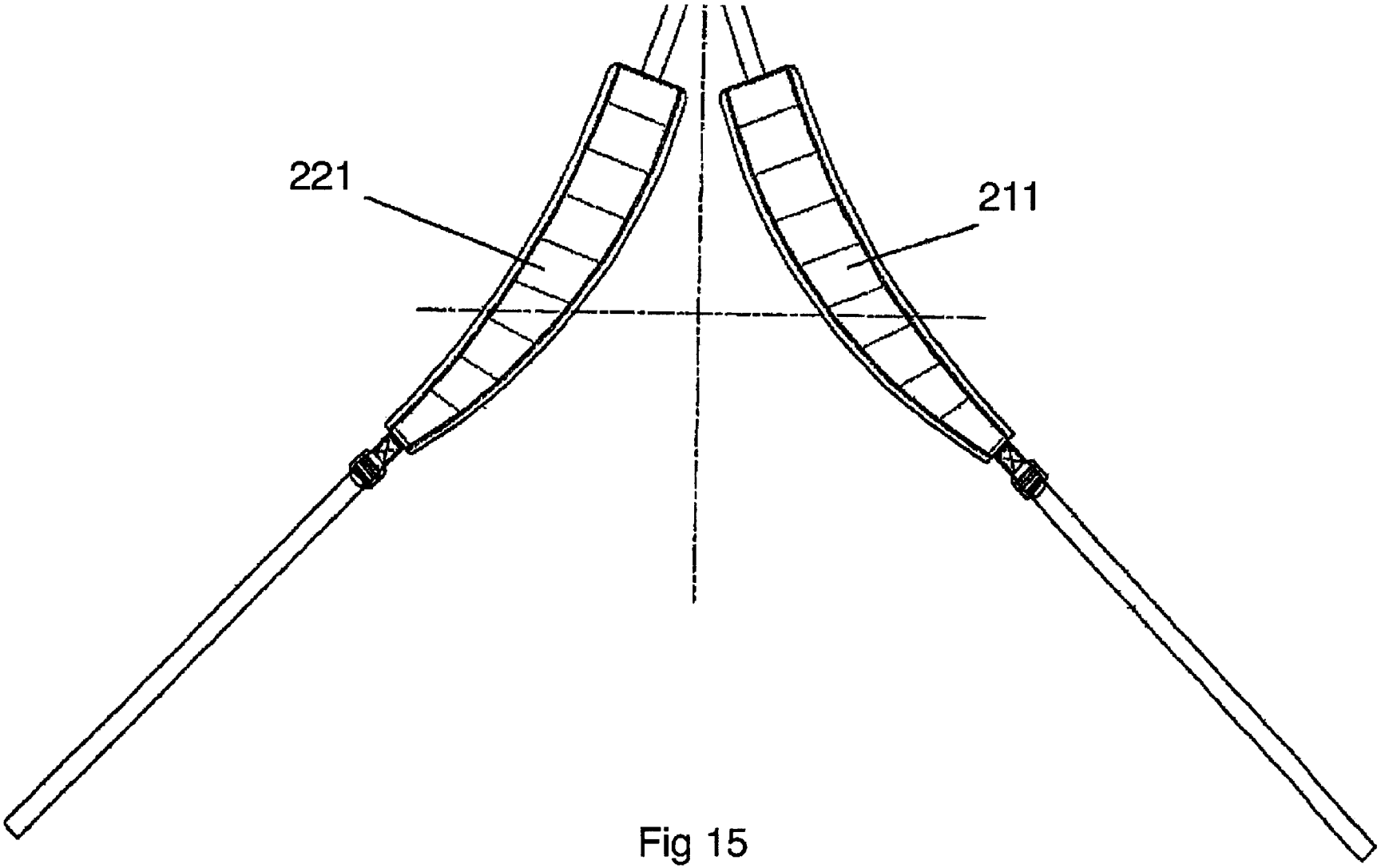
FIG. 15 illustrates a typical pair of ergonomically designed shoulder straps.
Figure 17:
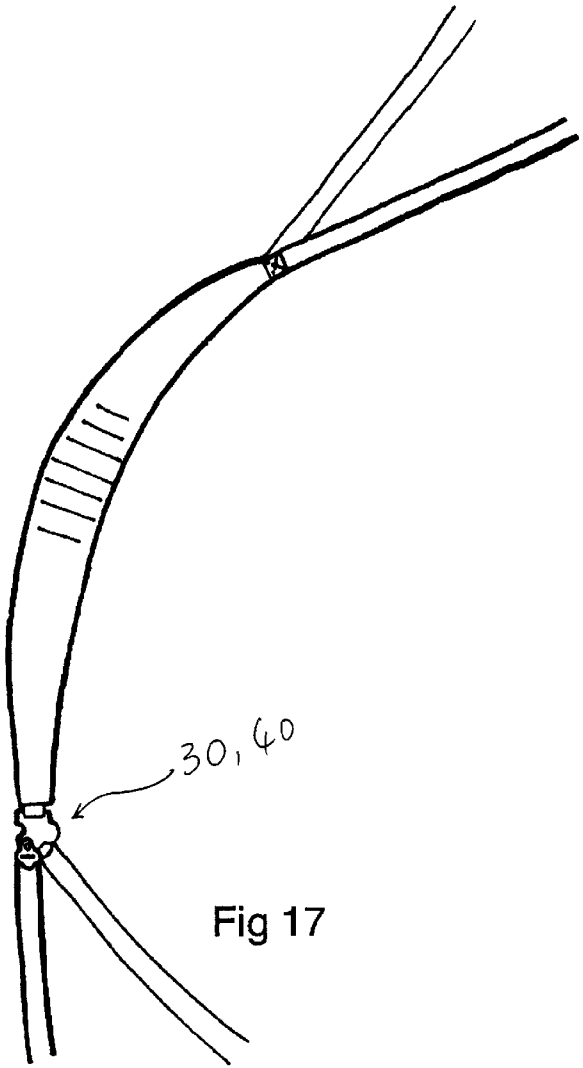
FIG. 17 illustrates a single-strap formed by combining the two strap elements of the dual-strap system of FIG. 1 adapted for carrying on the right shoulder.
Figure 16:
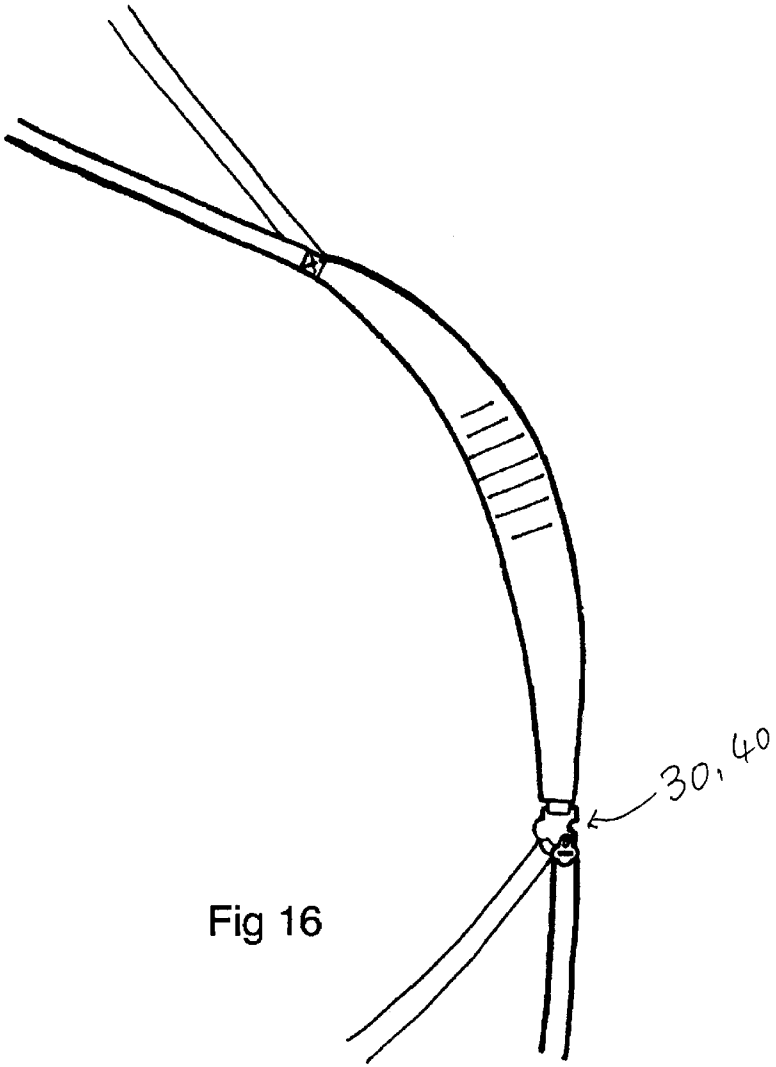
FIG. 16 illustrates a single-strap formed by combining the two strap elements of the dual-strap system of FIG. 1 adapted for carrying on the left shoulder.

Referring to FIGS. 9–11, to form a strap connector for a single strap carrying system from the present strap connector, it can be done by simply detaching the lateral members, reversing the lateral member having the key-hole portion, and then coupling the reversed lateral member with the lateral member having the stud member in a back-to-back manner. Because of the lateral symmetry of the two lateral members as shown in FIG. 1, the reversed lateral member will have a substantially same outline as the un-reversed lateral member and the combined connector would be substantial symmetrical about the plane of coupling. Such a formation of the strap connector by reversing one of the lateral members and then coupling the two lateral members together is desirable since it is well-known that ergonomically designed shoulder straps are not symmetrical about is longitudinal axis but are curved as shown in FIG. 15. By combining the first carrying strap and the reverse of the second carrying strap or vice versa, a single strap of double pad thickness but of an ergonomical design which can be used both for carrying on the left or right shoulders as shown in FIGS. 16 and 17 can be provided. With this quick and simple conversion, the dual-strap system can be easily converted into a single strap system and it is not necessary to carry the extra strap by the golf bag as an extra weight.

Furthermore, in combining the two shoulder straps to form a single strap, the ergonomical straps are preferably combined in a back-to-back fashion so that the padded surfaces of the constituting straps are always facing outside. An immediate consequence of such a combined strap is that it can be used on the left or right shoulder as both sides can be used and notwithstanding that each individual strap is designed for resting on a particularly shoulder.

Figure 12:
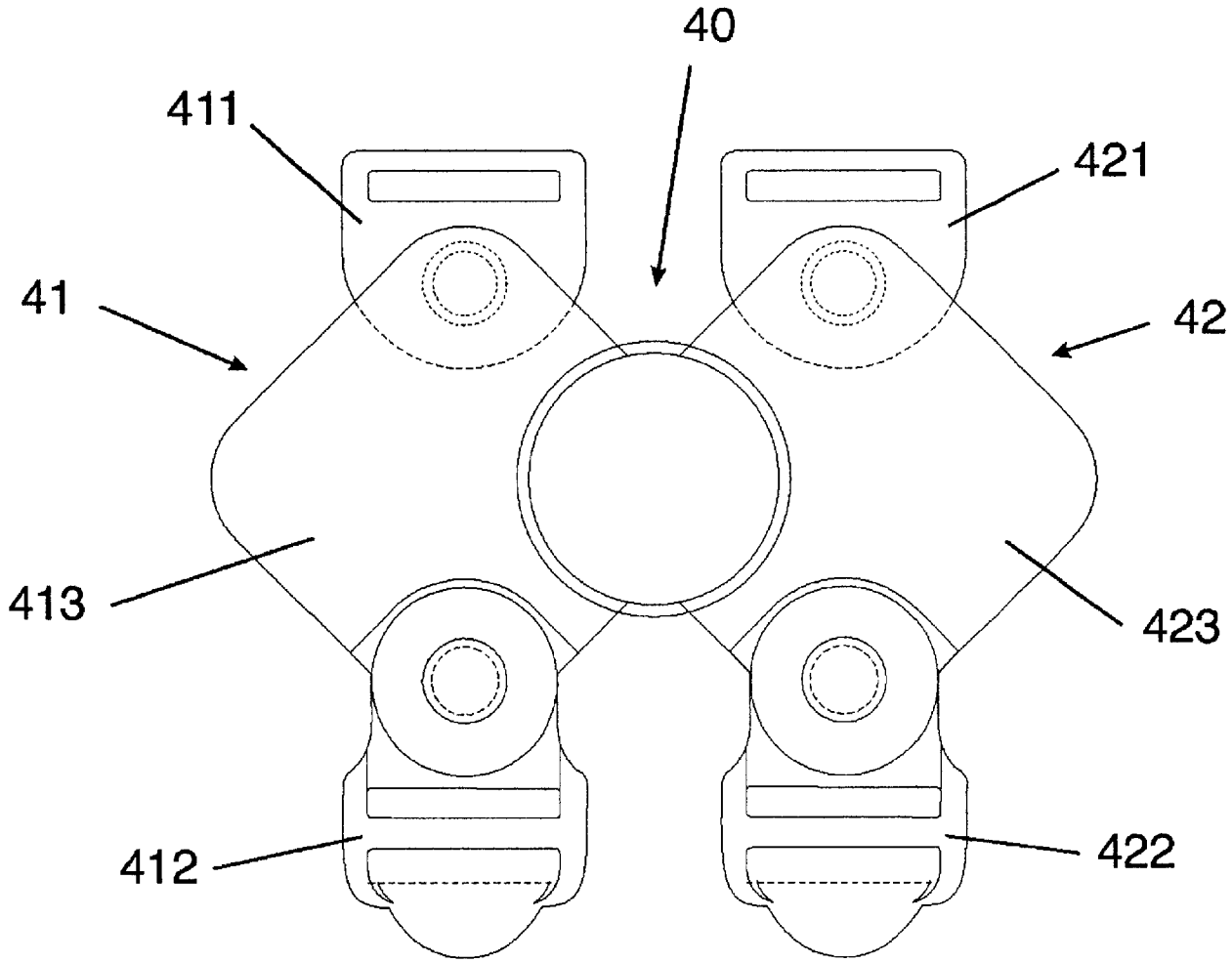
FIG. 12 shows a second embodiment of the strap connector of the present invention.
Figure 13:
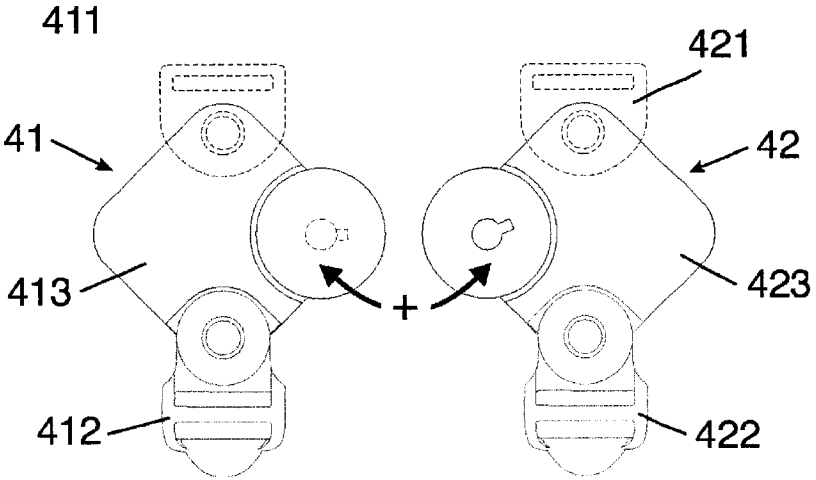
FIG. 13 shows the strap connector of FIG. 12 in a dis-assembled form.
Figure 14:
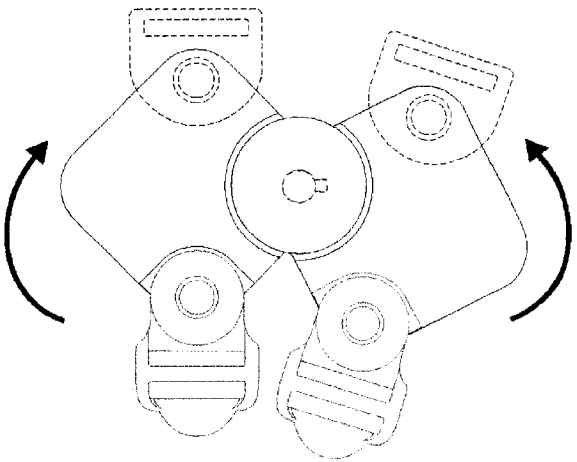
FIG. 14 illustrates the possible relative movements of the various moveable elements of the strap connector of FIG. 12.

Referring to FIGS. 12–14, there is shown a second embodiment of a strap connector (40) of the present invention. Similar to the first embodiment, the strap connector (40) also includes a first (41) and a second (42) lateral member which are pivotally connected. Each lateral member includes a first (411, 421) and a second (412, 422) strap anchoring means for receiving the shoulder strap (211, 221) and the lower strap (212, 222) portion. In this second embodiment, both strap anchoring means on each lateral member are pivotally attached to a main body (413, 423) of the lateral member (41, 42). The additional pivotally connected shoulder strap anchoring means (411, 421) allow more flexibility to the strap connector to adjust for weight distribution in response to the motion of the person carrying a golf bag. A part from the addition pivot connections of the shoulder strap anchoring means described above, it would be appreciated that the relevant descriptions on the first embodiment above will also apply to the present embodiment.

While the absolute dimensions of a strap connector is not particularly important, it would be appreciated that the total dimensions of a strap connector would be comparable to a size of the palm of an adult for aesthetic reasons.

While the present invention has been explained by reference to the specific embodiments described above, it should be understood and appreciated that the scope and extent of protection are not restricted by the embodiments described above and will include modifications, alternatives and variants which are trivial and developed on the basis of the general principles described above. In particular, it should be appreciated that the simplest form of the present invention would include a first and a second lateral member which are pivotally connected and on each of which there are formed two strap anchoring means, whether pivotally or fixedly.

What is claimed is:

1. A strap connector for a dual strap bag carrying system including first and second lateral members, said lateral members being pivotally connectable together at a first pivotal joint and are disposed on opposite sides of said first pivotal joint, each said lateral member includes a first and a second spaced apart strap anchoring means which are laterally displaced from said first pivotal joint and are disposed away from the other lateral member, said first pivotal joint being disposed intermediate between said first and second strap anchoring means of each said lateral member, and said first pivotal joint being surrounded by said first and second strap anchoring means of said first and second lateral members, wherein at least one of said strap anchoring means on each said lateral member being adapted for pivotally attaching a carrying strap to said lateral member.

2. A strap connector according to claim 1, wherein at least one of the strap anchoring means on each lateral member is pivotably moveable with respect to said lateral member on which it is attached.

3. A strap connector according to claim 1, wherein the two strap anchoring means on a lateral member of said strap connector are pivotally connected to said lateral member.

4. A strap connector according to claim 1, wherein the outline of said first and second lateral members are generally of mirror symmetry to each other.

5. A strap connector according to claim 1, wherein said first and second lateral members are detachably connected with each other.

6. A strap connector according to claim 5, wherein said first and second lateral members are coupled with a key-hole covering means.

7. A strap connector according to claim 5, wherein one of said lateral members can be detached and then attached to the other lateral member at said pivotal connection point in a back-to-back manner.

8. A strap connector convertible between a connector for a dual-strap and a single strap bag carrying system including first and second lateral members, said lateral members being pivotally connectable together at a first pivotal joint and are disposed on opposite sides of said first pivotal joint, each said lateral member includes a first and a second spaced apart strap anchoring means which are laterally displaced from said first pivotal joint and are disposed away from the other lateral member, said first pivotal joint being disposed intermediate between said first and second strap anchoring means of each said lateral member, and said first pivotal joint being surrounded by said first and second strap anchoring means of said first and second lateral members, wherein at least one of said strap anchoring means on each said lateral member being adapted for pivotally attaching a carrying strap to said lateral member.

9. A strap connector according to claim 8, wherein said lateral members are substantially of mirror symmetry.

10. A strap connector according to claim 8, wherein one of said lateral members can be detached and then attached to the other lateral member at said first pivotal joint in a back-to-back manner.

11. A dual-strap carrying system for a golf bag including first and second shoulder strap portions, first and second low strap portions, and a strap connector, wherein said strap connector includes first and second lateral members, said lateral members being pivotally connectable together at a first pivotal joint, each said lateral member includes a first and a second spaced apart strap anchoring means which are laterally displaced from said first pivotal joint and are disposed away from the other lateral member, said first pivotal joint being disposed intermediate between said first and second strap anchoring means of each said lateral member, and said first pivotal joint being surrounded by said first and second strap anchoring means of said first and second lateral members, wherein at least one of said strap anchoring means on each said lateral member being adapted for pivotally attaching a carrying strap to said lateral member.

12. A dual-strap carrying system of claim 11, wherein one of said lateral members can be detached and then attached to the other lateral member at said common pivotal joint in a back-to-back manner to form a single strap carrier.

13. A dual-strap carrying system comprising:

a first strap having first and second first strap portions each connected to said bag at one end and having a free end, a first strap connector having connectors at distal ends for connection to said free ends of said first and second first strap portions to form said first strap, at least one of said connectors of said first strap connector being pivotally movable relative to the other connector, a second strap having first and second second strap portions each connected to said bag at one end and having a free end, a second strap connector having connectors at distal ends for connection to said free ends of said first and second second strap portions to form said second strap substantially parallel to said first strap, at least one of said connectors of said first strap connector being pivotally movable relative to the other connector, and co-operating engagement means on said first and second strap connectors positioned intermediate of connectors to said strap portions and providing a pivotal connection between said first and second strap connectors.

14. A golf bag in combination with a dual-strap carrying system as claimed in claim 13.

15. A strap connector for a dual strap bag carrying system, said strap connector comprising:

first and second lateral members, said lateral members being pivotally connectable together at a first pivotal joint and are disposed on opposite sides of the pivotal joint, each said lateral member includes a first and a second spaced apart strap anchoring means which are laterally displaced from the first pivotal joint and disposed away from the other lateral member, said first pivotal joint being disposed intermediate between said first and second strap anchoring means of each said lateral member, and one of the strap anchoring means on each lateral member being pivotably moveable with respect to said lateral member on which it is attached.

16. A strap connector for a dual strap bag carrying system, said strap connector comprising:

first and second lateral members, said lateral members being pivotally connectable together at a first pivotal joint and are disposed on opposite sides of the pivotal joint, each said lateral member includes a first and a second spaced apart strap anchoring means which are laterally displaced from the first pivotal joint and disposed away from the other lateral member, said first pivotal joint being disposed intermediate between said first and second strap anchoring means of each said lateral member, and the two strap anchoring means on a lateral member of said strap connector being pivotally connected to said lateral member.

17. A strap connector for a dual strap bag carrying system, said strap connector comprising:

first and second lateral members, said lateral members being pivotally connectable together at a first pivotal joint and are disposed on opposite sides of the pivotal joint, each said lateral member includes a first and a second spaced apart strap anchoring means which are laterally displaced from the first pivotal joint and disposed away from the other lateral member, said first pivotal joint being disposed intermediate between said first and second strap anchoring means of each said lateral member, and said first and second member being detachably connected with each other.

18. A strap connector for a dual strap bag carrying system, said strap connector comprising:

first and second lateral members, said lateral members being pivotally connectable together at a first pivotal joint and are disposed on opposite sides of the pivotal joint, each said lateral member includes a first and a second spaced apart strap anchoring means which are laterally displaced from the first pivotal joint and disposed away from the other lateral member, said first pivotal joint being disposed intermediate between said first and second strap anchoring means of each said lateral member, and an outline of said first and second lateral members being of mirror symmetry to each other.

* * * * *